US006330861B1

(12) United States Patent
Flux

(10) Patent No.: US 6,330,861 B1
(45) Date of Patent: Dec. 18, 2001

(54) HEIGHT SAFETY SYSTEM

(75) Inventor: Peter Robert Flux, Inverness-Shire (GB)

(73) Assignee: Latchways PLC, Wiltshire (GB)

( * ) Notice: Subject to any disclaimer, the term of this patent is extended or adjusted under 35 U.S.C. 154(b) by 0 days.

(21) Appl. No.: 09/367,331

(22) PCT Filed: Feb. 12, 1998

(86) PCT No.: PCT/GB98/00435

§ 371 Date: Oct. 28, 1999

§ 102(e) Date: Oct. 28, 1999

(87) PCT Pub. No.: WO98/35724

PCT Pub. Date: Aug. 20, 1998

(30) Foreign Application Priority Data

Feb. 12, 1997 (GB) ..... 9702855

(51) Int. Cl.[7] ..... B61B 7/00
(52) U.S. Cl. ..... 104/115; 182/3; 182/8
(58) Field of Search ..... 104/115; 182/3, 182/4, 5, 6, 7, 12, 36, 45, 8, 100, 106, 219

(56) References Cited

U.S. PATENT DOCUMENTS

| | | | | |
|---|---|---|---|---|
| 3,885,647 | * | 5/1975 | Acosta | 182/8 |
| 4,111,280 | * | 9/1978 | Devine et al. | 182/8 |
| 4,269,284 | * | 5/1981 | Swager | 182/8 |
| 4,852,690 | * | 8/1989 | Salmi | 182/219 |
| 5,092,426 | * | 3/1992 | Rhodes | 182/3 |
| 5,224,427 | * | 7/1993 | Riches et al. | 104/115 |
| 5,297,651 | | 3/1994 | Vandelinde . | |
| 5,343,975 | * | 9/1994 | Riches et al. | 182/3 |
| 5,350,037 | | 9/1994 | Ghahremani . | |
| 5,522,472 | * | 6/1996 | Shuman, Jr. et al. | 182/3 |
| 5,979,599 | * | 11/1999 | Noles | 182/3 |

FOREIGN PATENT DOCUMENTS

| | | |
|---|---|---|
| 0273673A1 | 7/1988 | (EP) . |
| 0608164A1 | 7/1994 | (EP) . |
| 2681253 | 3/1993 | (FR) . |
| 1581109 | 12/1980 | (GB) . |
| 2261202A | 5/1993 | (GB) . |
| 2289377A | 11/1995 | (GB) . |
| 2291846A | 2/1996 | (GB) . |
| WO9220407 | 11/1992 | (WO) . |

OTHER PUBLICATIONS

Copy of British Search Reported dated Apr. 17, 1997.
Copy of International Search Reported dated May 19, 1998.

* cited by examiner

*Primary Examiner*—S. Joseph Morano
*Assistant Examiner*—Lars A. Olson
(74) *Attorney, Agent, or Firm*—Tarolli, Sundheim, Covell, Tummino & Szabo L.L.P.

(57) ABSTRACT

A height safety system includes an elongate semi-rigid element (310) suspended from its end under tension between a pair of fixed anchors and is supported by intermediate guides (331). Shuttle means (360) are installed on the element (310) and are adapted for movement therealong between the fixed anchors. The shuttle means (360) are provided with attachment devices (365) for receiving a suspended load or a personnel safety line. The intermediate guides (331) are designed to grip the element (310) with a predetermined clamping force that allows limited slippage of the element (310) therethrough in response to an applied tensile load exceeding the clamping force. Slippage no longer occurs when the tensile load equals the predetermined clamping force. In this way, the tensile load is partially transferred to an adjacent span of the element (310).

19 Claims, 8 Drawing Sheets

HEIGHT SAFETY SYSTEM

FIELD OF THE INVENTION

The present invention relates to load transfer and personnel safety apparatus and, in particular, to a versatile, flexible track and shuttle system which is capable of operating in both load transfer and personnel safety modes as a height safety system and which combines in a single invention the advantages of known cable systems and known fixed track systems.

BACKGROUND OF THE INVENTION

Load transfer devices have numerous applications, for example in building, mining and civil engineering for transferring loads along an elongate overhead guide such as a cable, rod or track. Such arrangements may also find use in transferring goods and/or personnel from ship to shore and vice versa at quayside locations.

Some known load transfer devices suffer from the drawback that they are incapable of negotiating the intermediate brackets along the elongate support element. One solution to this problem is to provide special brackets which can be "opened" to allow the supported load to pass. The weakness of this approach is that the elongate support element temporarily lacks support at the very point where the installer thought it necessary and at the precise moment when it is most needed. Another likely problem is that the brackets may not be accessible to the system user.

An alternative solution is to employ special entry/exit fittings or access points along the elongate support element so that the load transfer device can be attached and removed. The drawback of this proposal is that the access points are not always conveniently situated in relation to the exact location at which attachment or removal is desired.

Improved load transfer devices have been developed which are capable of automatically traversing intermediate brackets for the elongate support element without user intervention. Such devices typically comprise a pair of rotatable wheels having a series of recesses at spaced locations around their peripheries, the adjacent recesses being separated by a radially projecting part of the wheel. A cooperating slipper part is mounted on the wheels by means of formations which inter-engage with complementary formations on the radially projecting wheel parts. A space between the slipper part and the wheels is dimensioned to receive an elongate support element such as a cable or a rigid elongate element.

In use, the device is able to negotiate intermediate brackets for the elongate support element without user intervention by accommodating the bracket legs in a pair of aligned recesses carried by the respective wheels. Rotation of the wheels relative to the slipper part causes the intermediate bracket to pass behind the slipper part, in the aligned recesses of the rotating wheels. Examples of such devices are described In the Applicant's British Patent No. 2 096 958 and in International Patent Application No. WO96/02456.

Similarly, vertical fall arrest devices are an important accessory for maintenance personnel who climb tall structures, since they enable the hazard of falls to be minimised. Vertical fall arrest systems which employ a safety line such as a flexible cable for engagement by the fall arrest device require intermediate support brackets to restrain the cable from buffeting against the tall structure while under wind loading. Such systems therefore present a practical problem of enabling the fall arrest device (and the user) to bypass the support brackets without increasing the fall hazard.

Certain known designs attempt to overcome this bypass problem by using a manually operated bracket lock. This requires the user to open and close the bracket when he traverses it. Other known designs require that the user should lean out from the normal climb/descend posture and pull the cable away from the bracket in order to move the fall arrest device past the bracket position. Both of these methods add significantly to the difficulty of the climb, are more tiring and hence possibly increase the fall hazard.

Another problem facing maintenance personnel on very tall structures such as telecommunication pylons, masts etc. is the provision of a number of discrete vertical fall arrest systems up the side of the structure. This is due to the fact that ladder placement is often along a number of different climbing axes. Such structures may therefore require the detachment and re-attachment of the fall arrest device at any point during the climb or descent, and the ease by which this can be achieved is an important factor in determining the overall safety of the maneuver.

Examples of a vertical fall arrest devices that address the aforementioned problems are described in the Applicant's International Patent Application Nos.

WO95/26784 and WO96/09089. These devices work on a similar principle to the known load transfer devices described above, in that intermediate support brackets are traversed by accommodating them in radially-disposed notches provided in rotatable wheels forming an essential feature of the fall arrest device. The rims of said wheels are enclosed behind a so-called "slipper" member, this inter-engagement serving to prevent undesired disengagement of the fall arrest device from the elongate support element.

One of the drawbacks of known fall arrest systems has already been mentioned above: Very tall structures are often provided with a number of discrete vertical fall arrest systems at different locations around the periphery of the structure, ladder placement being along a number of different climbing axes. Hence, maintenance personnel must detach themselves from one vertical fall arrest system and undertake a horizontal traverse, perhaps unsecured, before attaching themselves to the next span of vertical safety line.

Another disadvantage is that limitations arise in passing support brackets, particularly when negotiating corners. This problem is made more difficult to overcome when the user is not optimally aligned with the intermediate support brackets, for example when operator freedom is restricted by narrow walkways or when equipment orientation is hindered by restricted wire positions.

Presently-known systems are usually designed around an elongate wire or rod element, or a rigid track profile. Both of these have their own inherent advantages and limitations. A wire is usually preferred for long systems and where few intermediate anchor and/or support positions are available. Such systems are also simple in design, relatively cheap to install and hence cost-effective. However, a wire has the disadvantage that it must be supported by an element such as a loop which at least partially surrounds the wire. Hence, the running surface is periodically interrupted and special provisions must be made for negotiation of intermediate supports, as discussed above. A rigid track is better suited to a situation where there are numerous intermediate support and fixing points. Track has advantages for relatively heavy loads and may be better suited to systems subjected to frequent use. Obviously, rigid tracks do not allow such a flexible approach to installation and are Inherently more costly, particularly if building modifications are required to install sub-structures for supporting track.

A track system is known from French Patent Application No. 2 681 253 which discloses at least one profiled rail suspended from supports. The rail Is equipped with prestressing means and has a running surface that is adapted to receive at least one trolley In a freely sliding manner. The trolley has means for receiving a hook such as a karabiner clip which is used to link the device to the personal safety harness of a user.

SUMMARY OF THE INVENTION

It is therefore an object of the present invention to provide a versatile, flexible track and shuttle system that is capable of operating in both load transfer and personnel safety modes and which combines in a single invention the advantages of known cable systems and known rigid track systems. It is a further object of the invention to provide a track and shuttle system that is capable of operating in both load transfer and personnel safety modes and which offers a continuous running surface for shuttle means without interruption by intermediate support brackets. It is yet another object of the invention to provide a track and shuttle system that is capable of operating in both load transfer and personnel safety modes and which avoids the need for special entry/exit fittings on the system. It is a still further object of the invention to provide a track and shuttle system that is capable of operating in both load transfer and personnel safety modes and which includes surface formations along the track for the locking and/or clamping of shuttles relative thereto, when certain conditions arise in use. Yet another object of the invention is to provide a track and shuttle system that is capable of operating in both load transfer and personnel safety modes in substantially horizontal or substantially vertical orientations, and orientations in between, in the same installation and without the need for separate track placements for each change in orientation.

The invention is a height safety system comprising a flexible elongate element, the element being pre-tensioned/stressed between support brackets at intervals to stiffen its linear form, and shuttle means coupled to the elongate element adapted for movement therealong, the shuttle means including attachment means for receiving a suspended load or a personnel safety line;

characterised in that the element has primary and secondary track formations dependent from each other, the primary track formation providing a continuous path along which the shuttle means is able to traverse without interruption, and the secondary track formation providing attachment points for the support brackets at any point along the extent of the element without obstructing the primary track formation.

For the avoidance of doubt, it is expressly stated here that the degree of pre-tensioning/stressing imparted to the flexible elongate element exceeds any inherent tensile loading in the system which arises from having to support the weight of the flexible track.

In a particularly preferred form of the invention, the elongate element is multiple-lobed in cross-section. In such an arrangement, one of the lobes may be engaged by intermediate guide brackets for guiding the suspended element around corners and through bends, or from a horizontal orientation to a vertical orientation or, if desired, at any required inclination in between. At least one of the other lobes is maintained free from intermediate guides or supports to provide an uninterrupted running surface for the shuttle means.

One or more of the lobes may carry a filamentary reinforcement, such as a braided wire, aramid cable or a polyamide/polyester rope, for transmitting tensile loads through the installation. The wire may form part of an end anchoring arrangement, and may. have a diameter typically in the range of 6 to 8 mm. Such filamentary reinforcement increases the choice of materials that may be used for the elongate element so that it can be matched to the material of the shuttle means for ensuring smooth operation. The tensile function of the track may be borne entirely by the filamentary reinforcement.

Discrete lengths of the elongate element may be joined by any suitable means which ensure that the continuous smooth track profile is not interrupted at the joints. Conveniently, track joints are accommodated within the jaws of an intermediate support bracket which helps to ensure that track alignment is maintained between adjoining lengths. Multiple-lobed versions of the track may be provided with joining pins or dowels inserted in the lobe ends to assist in the track alignment process.

Alternatively, the elongate element may be a flat strip of a self-supporting material such as spring steel. Such a material may be twisted through different orientations in use and is capable of flexing during passage of a load, but returns to form when the applied load is removed. Optionally, the flexible flat strip may be provided with a lobe on its rear surface, either continuously or at intervals, said lobe being engageable by intermediate guides if required.

The elongate element may be provided with entry gates for removal and installation of shuttle means, if desired. Also, the elongate element may have an aerodynamic profile that minimises "chattering" when buffeted by winds.

In one possible arrangement of the invention, the elongate element may be slidable relative to said intermediate guides so that tensile forces experienced by the elongate element are transmitted to the end anchors. Alternatively, the elongate element may be supported by intermediate brackets which grip it with a predetermined force and which allow the elongate element to pay through the bracket jaws by a predetermined distance in response to sudden shock loading, for example in a fall arrest situation. This is helpful, not only in controlling the fall distance, but also in controlling the end loadings for the entire installation. Unlike prior art arrangements that concentrate peak forces at the end anchors, the present invention is capable of spreading the peak forces over a plurality of intermediate positions. This is advantageous during design of new buildings because it means that the structure upon which the elongate element is to be installed does not have to specially reinforced. Also, the system can be retrofitted to existing constructions without needing to install massive structures for peak end loading. In another preferred form, the elongate element may be a hollow profile and the intermediate guides may take the form of droppers engageable with the interior of the elongate element.

The configuration of the shuttle means may be such that it partially encircles the elongate element or, in the case of a multiple-lobed version, one or more of its lobes. The shuttle means may be formed with wheels, rollers, ball races or similar anti-friction devices to assist in their smooth passage along the track. They may also be configured to be removable from the track at positions remote from any entry gates provided in the system. The capability for removal may be realized by making one part of the shuttle means movable in a direction away from the longitudinal axis of the elongate element. Preferably, removable shuttle means are arranged to be fail-safe to prevent non-intentional removal. Positive action is required on the part of the user to deactivate the fail-safe feature before the shuttle means can be removed from the track.

The elongate element and the shuttle means may also be provided with complementary formations such as serrations, ratchet teeth or other non-plain surface features for cam locking purposes in a fall-arrest situation. Such non-plain surface features may be effective to allow a limited degree of slippage of the elongate element relative to an intermediate support bracket in response to sudden shock loading. In this way, peak loads can be dissipated through a number of intermediate support brackets rather than being transmitted solely to the fixed terminal anchors. Special intermediate support brackets may be employed to permit such limited slippage, or pull-through, when the tensile loading in a span of the elongate element exceeds a predetermined value.

Of course, the provision of non-plain surface features may be restricted to the extreme ends of the elongate element for the purpose of ensuring sound gripping by the fixed anchors Advantageously, the fixed anchors may also be provided with complementary surface formations to promote gripping.

DESCRIPTION OF THE DRAWINGS

The invention will now be described by way of example only with reference to the drawings, in which.

DESCRIPTION OF AN EMBODIMENT OF THE INVENTION

Figure 1:
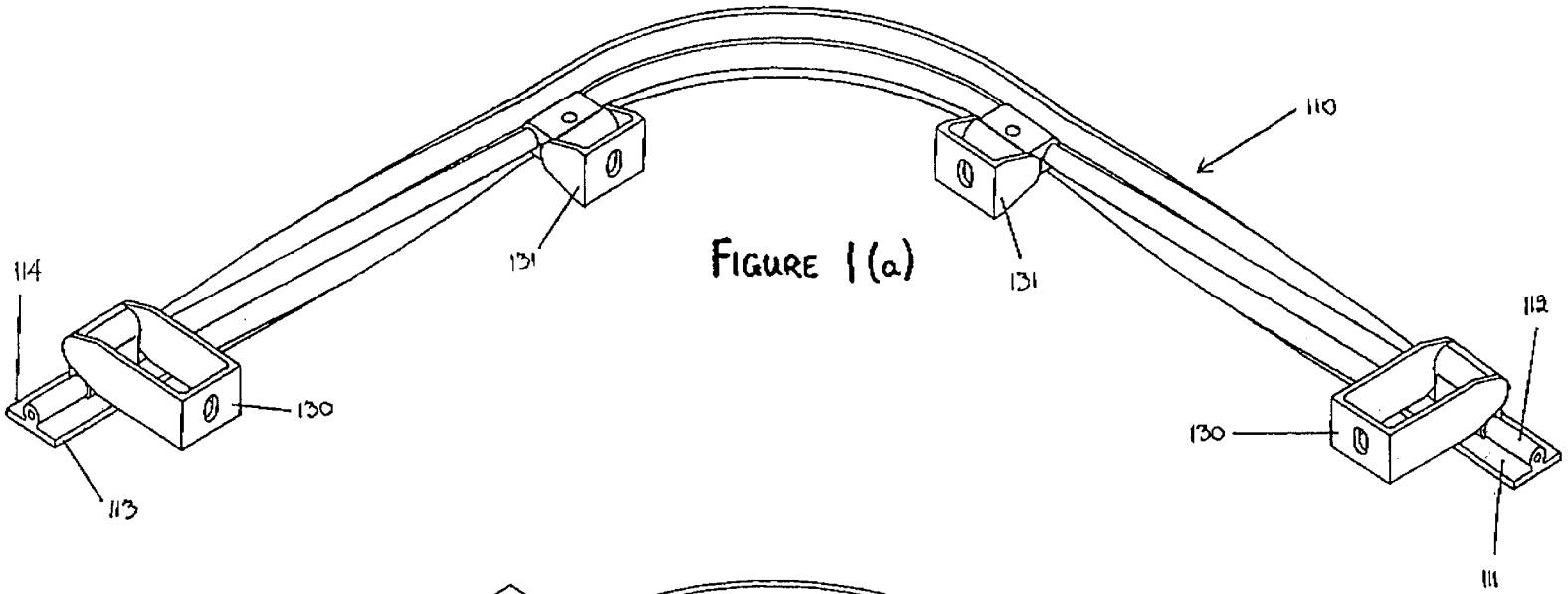
FIGS. 1(*a*) and 1(*b*) show two perspective views of a span of flexible track in accordance with an embodiment of the present invention showing how it is guided around external and internal corners, respectively.
Figure 1:
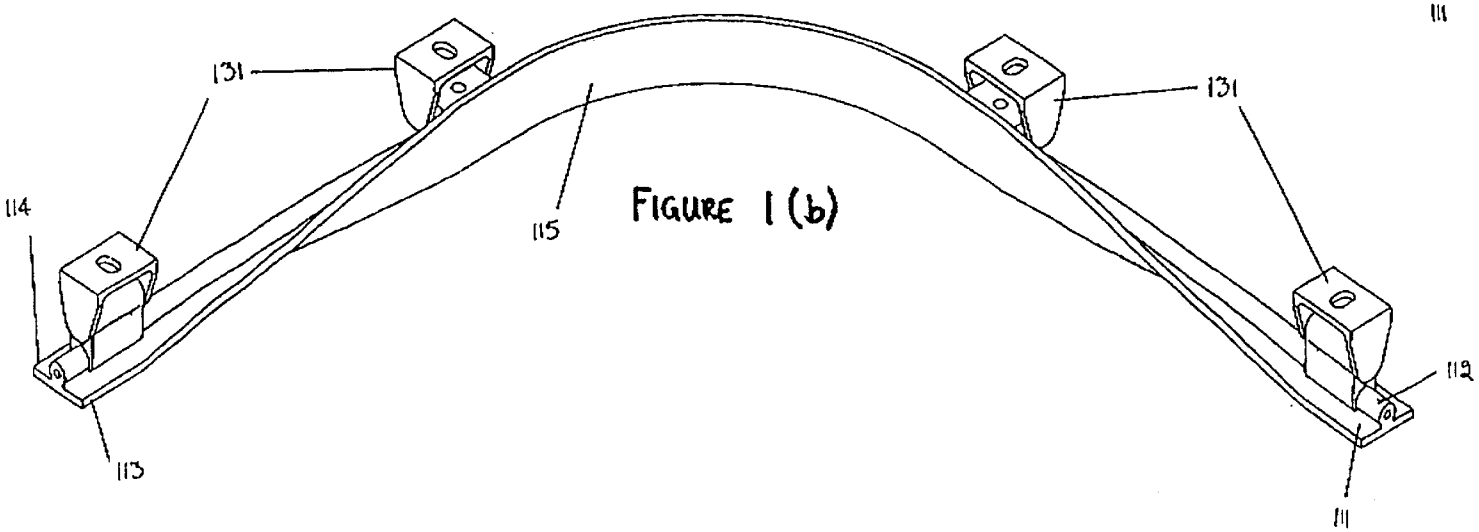

Referring now to FIGS. 1(*a*) and 1(*b*), there is shown a flexible elongate element 110 comprising a spring steel strip 111 formed with a lobe 112 affixed to the middle of one of its faces. The lobe 112 serves as the attachment point for support of the elongate element by intermediate brackets 130, 131. The edges 113, 114 and non-lobed face 115 of the elongate element 110 form an uninterrupted running surface for shuttle means (not shown).

The view in FIG. 1(*a*) depicts the arrangement of an external bend and shows how the elongate element executes a 90° helical twist as it approaches the apex of the bend. Cantilever brackets 130 support the elongate element 110 in its "normal" orientation with the non-lobed face 115 facing downwards. Short-arm brackets 131 support the elongate element 110 in its "twisted" orientation adjacent the apex of the bend. Both types of bracket are clamped onto the lobe 112 in use.

FIG. 1(*b*) shows the arrangement of an internal bend supported entirely on short-arm brackets 131. As in the arrangement depicted in FIG. 1(*a*), the elongate element 110 executes a 90° helical twist at the apex of the bend.

The brackets 130, 131 can be swivelled/aligned before tightening in position for optimum orientation of the flexible elongate element 110. One embodiment of orientable bracket is described in more detail below with reference to FIG. 4.

Figures 2A, 2B, 2C:
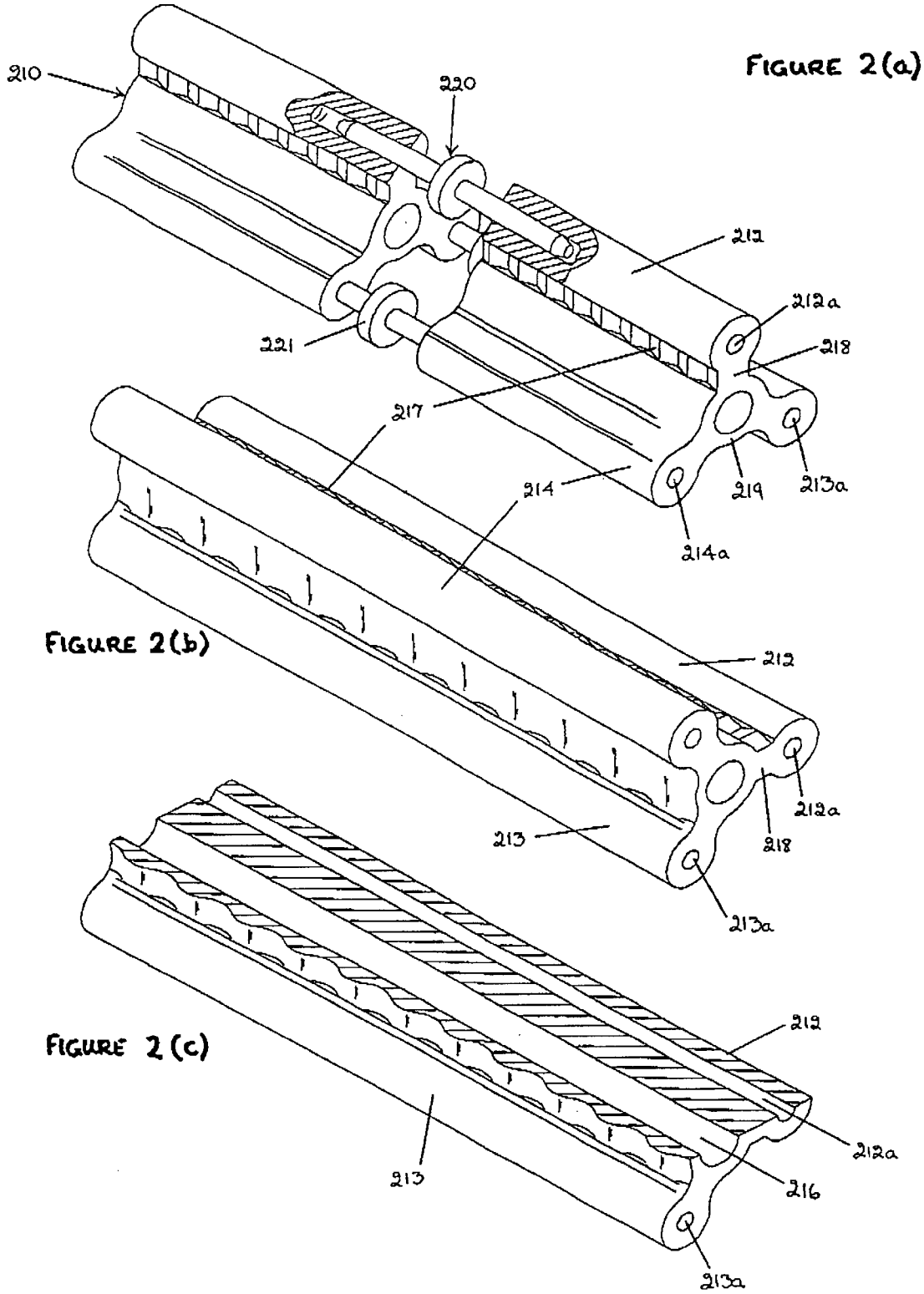
FIGS. 2(*a*), 2(*b*) and 2(*c*) show three perspective views, one in partial section, of a length of flexible track in accordance with another embodiment of the invention illustrating various internal and external features of the track.

Turning now to FIGS. 2(*a*), 2(*b*) and 2(*c*), this shows a preferred track profile for an elongate element 210 and various features thereof. As seen in FIG. 2(*a*), elongate element 210 is formed as a trilobal extrusion having a central core 219 and three lobes 212, 213, and 214. Lobe 212 serves as a support lobe and is provided with a pattern of serrations 217 on the web 218 joining the lobe 212 to the central core 219. The serrations 217 are dual-purpose, being designed to be gripped securely in terminal anchors and by torque-set clamps as described in more detail below with reference to FIGS. 4(*a*), 4(*b*), 5(*a*) and 5(*b*).

Each lobe 212, 213 and 214 is provided with a respective through-aperture 212*a*, 213*a*, 214*a* adapted to receive a joining plug 220 for ensuring that the lobes of conjoined elongate elements 210 are in perfect alignment. Plug 220 is provided with a flange 221 at its midpoint which ensures equal depth of penetration of the plug 220 into adjacent track ends. This avoids the possibility of defective coupling between adjacent track lengths that may result if one of the plug ends penetrates only a very short distance into its respective track aperture. As mentioned above, track joints may be clamped between the jaws of an intermediate support bracket that prevents track creep during use which might otherwise lead to separation at the joints.

In an alternative arrangement (not shown), one or more of the through-apertures 212*a*, 213*a* and 214*a* may carry a continuous filamentary reinforcement such as a braided steel wire, an aramid cable, or the like. The continuous filamentary reinforcement fulfils the same function as joining plug 220 in ensuring proper alignment of adjacent track lengths for achieving an uninterrupted running surface.

FIG. 2(*b*) shows the underside of elongate element 210 between lobes 213 and 214. This region of the elongate element 210 is provided with an undulating formation on its surface. This is used in some variants of the invention for engagement by a shuttle which deploys a locking clutch or cam to arrest shuttle motion by a cam-locking action if a predetermined speed is exceeded.

FIG. 2(*c*) shows a perspective cross-sectional view of a length of elongate element 210 showing central aperture 216 which passes through core portion 219. The aperture 216 provides the option of reinforcing the track installation with an additional tensile element such as a braided steel cable, an aramid fibre reinforcement, or similar. Such reinforcement can be used to transmit tensile loads through the entire length of the elongate element between its end anchors without requiring tensile coupling between adjoining lengths of the track. FIG. 2(*c*) also shows aperture 212*a* passing through lobe 212. In an alternative arrangement, the respective apertures 212*a*, 213*a* and 214*a* formed in lobes 212, 213 and 214 may be blind holes rather than through-apertures.

In an especially advantageous embodiment of the invention, however, the brackets 331 may be designed to permit a certain degree of pull-through of the flexible elongate element 310 in response to sudden shock loading, for example in a fall arrest situation.

Figure 3:
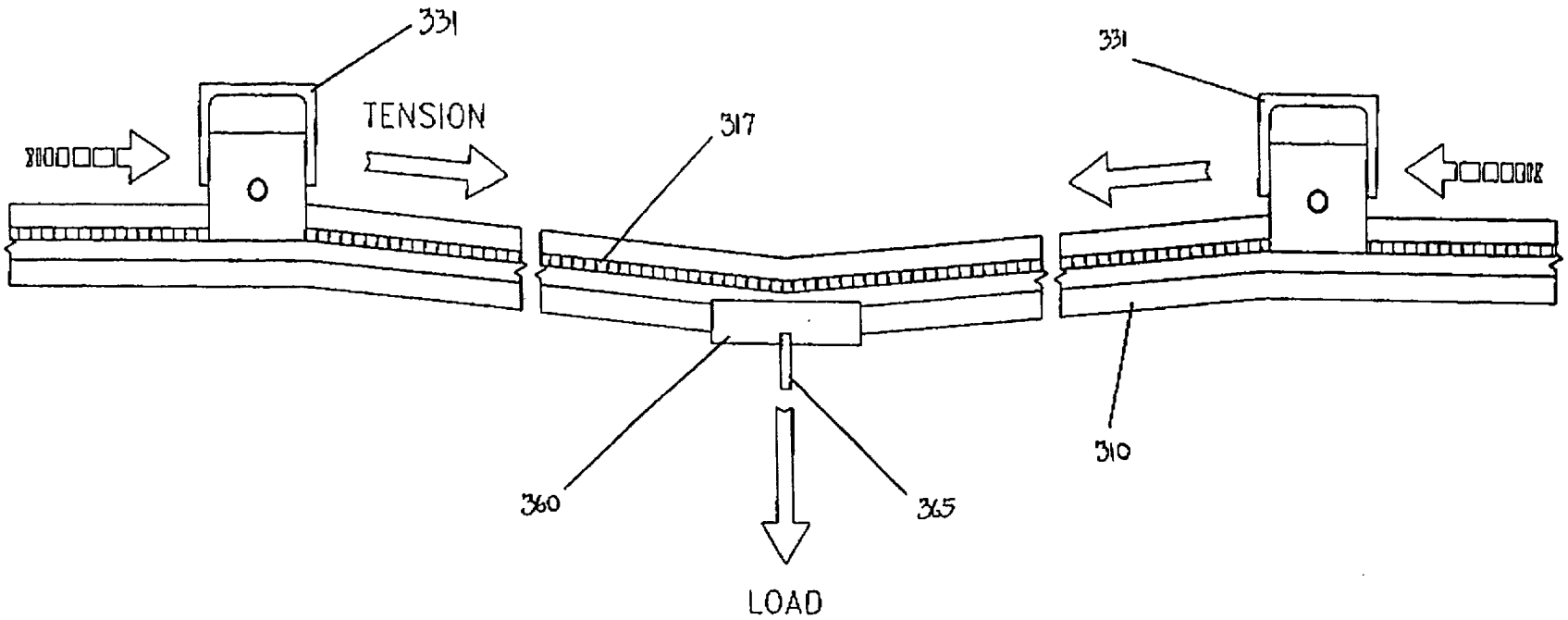
FIG. 3 shows a front view of a span of flexible track in accordance with the embodiment of FIGS. 2(*a*), 2(*b*) and 2(*c*) showing how tensile loads are transmitted along it past intermediate guides.

FIG. 3 shows a front view of a span of flexible track in accordance with one embodiment of the invention. This shows how the flexible elongate element 310 becomes slightly distorted under load between two support brackets 331. Brackets 331 may be of two alternative designs, depending of the intended performance of the installation. In one form, the brackets 331 may be formed with non-serrated clamping jaws that allow the flexible elongate element 310 to slide through the jaws with relative ease in order to transmit tensile loading to the end anchors. Alternatively, the jaws of the bracket 331 may be provided with complementary serrations that bite into the serrations 217 formed on the flexible elongate element 310. Such an arrangement provides for a more positive gripping of the flexible elongate element 310 and the arrangement may be such that no slippage occurs.

Figures 4A, 4B:
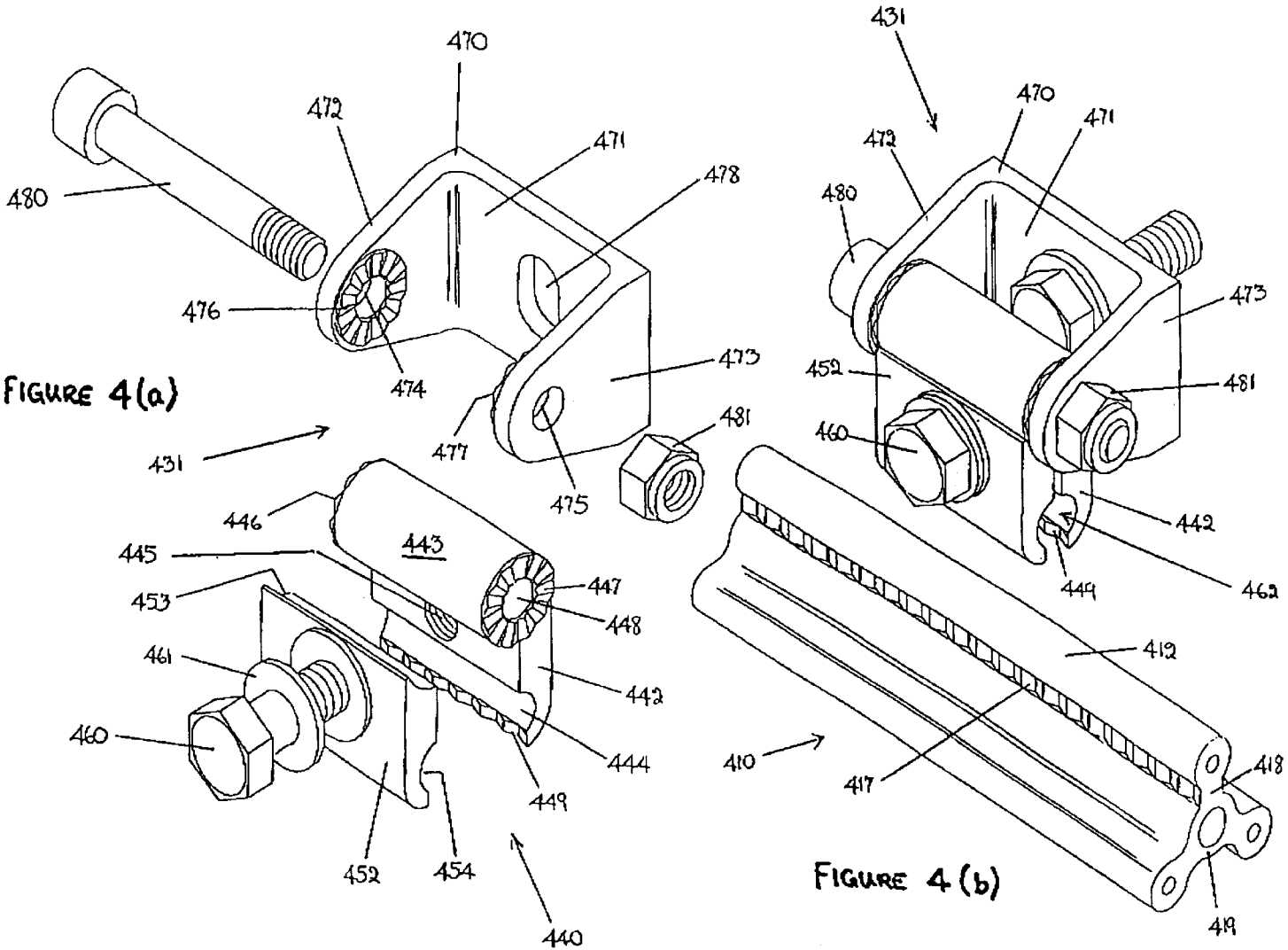
FIGS. 4(*a*) and 4(*b*) show a series of perspective views of a particularly preferred form of intermediate support bracket for supporting the flexible track of FIG. 2.

A particularly preferred form of support bracket is illustrated in FIGS. 4(*a*) and 4(*b*). As seen in FIG. 4(*a*), the bracket 431 comprises a generally U-shaped bracket hanger 470 and a track clamping unit 440 consisting of a pair of separable clamping elements 442, 452.

The bracket hanger 470 has a back plate 471 provided with an aperture 478 for secure attachment of the bracket hanger to a part of a permanent structure to which the track 410 is to be attached. The back plate 471 supports a pair of opposed parallel arms 472, 473, each arm being provided with a respective through-hole 474, 475 for receiving a threaded bolt 480 therethrough. The opposing surfaces of the arms 472, 473 are formed with a respective pattern of serrations 476, 477 surrounding the respective through-holes 474, 475. The purpose of these serrations will be explained in more detail below.

As already mentioned, the track clamping unit 440 comprises a pair of first and second separable clamping elements 442, 452. These are adapted to be joined together in clamping relationship by a threaded bolt 460.

First clamping element 442 includes a barrel formation 443 adjacent its upper portion, the barrel formation 443 having a through-hole 448 adapted to receive threaded bolt 480 described above. The end faces of the barrel formation 443 are provided with patterns of serrations 446, 447 which are designed to co-operate in use with the respective serrations 476, 477 formed on the opposing faces of arms 472, 473 in the bracket hanger 470. In its mid portion, first clamping element 442 is provided with a threaded hole 445 for receiving threaded bolt 460 for effecting clamping of a length of track 410 in a manner to be described in more detail below. The lower edge of first clamping element 442 is formed as a jaw having a longitudinal array of serrations 449 configured to be a complementary fit with serrations 417 formed on the flexible elongate element 410 to be supported. Adjacent the serrations 449, first clamping element 442 has a part-circular groove 444 dimensioned to be a snug fit around a lobe 412 of the flexible elongate element 410.

Second clamping element 452 is formed in its upper portion with a part-circular groove 453 which conforms in cross-section to the external diameter of barrel formation 443 of the first clamping element 442. In its mid-portion, second clamping element 452 is provided with a hole (not shown) that receives threaded bolt 460 for securing the two clamping elements 442, 452 together in clamping relationship around a lobe 412 of a length of flexible track 410. The lower edge of second clamping element 452 is also formed as a jaw having longitudinal serrations (not visible in this view) that are a complementary fit with serrations 417 formed on the flexible elongate element 410. Adjacent the serrations, second clamping element 452 has a part-circular groove 454 dimensioned to be a snug fit around lobe 412 of the flexible elongate element 410.

Threaded bolt 460, used for clamping the first and second clamping elements 442, 452 together, is provided with a disc spring 461 which controls the clamping force exerted around lobe 412 of the flexible elongate element 410 to be supported.

In use, the bracket 431 is installed by first securing the bracket hanger 470 in place on a part of the permanent structure to which the track is to be attached. Then the first clamping element 442 is offered up to the gap between the arms 472, 473 of the bracket hanger 470 in such a way that the through-hole 448 of the first clamping element 442 aligns with the respective holes 474, 475 of the arms 472, 473. Threaded bolt 480 is then passed through the aligned holes 474, 448 and 475, and nut 481 is loosely threaded onto the protruding end of bolt 480. In this condition, the serrations 476, 477 surrounding the holes 474, 475 in the arms 472, 473 engage with the serrations 446, 447 at the respective ends of the barrel formation 443 of the first clamping element 442, but the first clamping element 442 is still rotatable around the threaded bolt 480. This enables the first clamping element 442 to be positioned in any desired orientation relative to the bracket hanger 470 before the nut 481 is tightened to draw the ends of the arms 472, 473 closer together and thereby prevent further rotation of the first clamping element 442 by virtue of the locking engagement between respective pairs of serrations 476, 446 and 477, 447.

Having thus determined the orientation of the first clamping element 442 relative to the fixed structure, the second clamping element 452 carrying the clamping bolt 460 and disc spring 461 is offered up to the first clamping element 442 in such a way that the part-circular groove 453 abuts barrel formation 443 such that the end of bolt 460 aligns with threaded hole 445 in the first clamping element 442. Bolt 460 is loosely threaded into hole 445 so that the respective part-circular grooves 444, 454 in the lower portions of the first and second clamping elements 442, 452 define a channel adapted to receive a lobe 412 of the flexible elongate element 410 to be supported.

An assembled support bracket 431 is shown in FIG. 4(*b*). Beneath the support bracket 431, there is shown a length of flexible track 410 having an upper lobed portion 412 that is intended to be received in channel 462 defined by the lower portions of the first and second clamping elements 442, 452.

Prior to final tightening of the threaded bolt 460 into the hole 445 in the first clamping element 442, the jaws of the first and second clamping elements 442, 452 are pried apart to allow insertion of the uppermost lobe 412 of the flexible elongate element 410. The serrations 449 on the jaws of the clamping elements engage with like serrations 417 formed on the web 418 joining the lobe 412 to the central core 419 of the flexible elongate element 410. The threaded bolt 460 is then tightened to a predetermined torque against the biasing force of disc spring 461 so that a controlled clamping force is exerted by the clamping element jaws around the lobe 412 of flexible elongate element 410.

The mode of operation of the bracket 431 may be more readily understood with reference to the following example:

If the normal load on the flexible elongate element 410 is estimated to be 5 kN, the torque on the clamp disc spring 461 may be pre-set to allow slippage at 8 kN. In such circumstances, when the tension in the track reaches 8 kN, the track slips through the clamp bracket by a finite distance of, say 15 mm, and the tensile load is partially transferred to the next span. In effect, the bracket 431 acts as a shock absorber, and the track will pull through the support clamp until the load equals the clamping force. An installation which is comprised entirely of such torque-set clamps is extremely effective in reducing the massive loadings that might otherwise need to be borne by terminal end anchors.

Figures 5A, 5B:
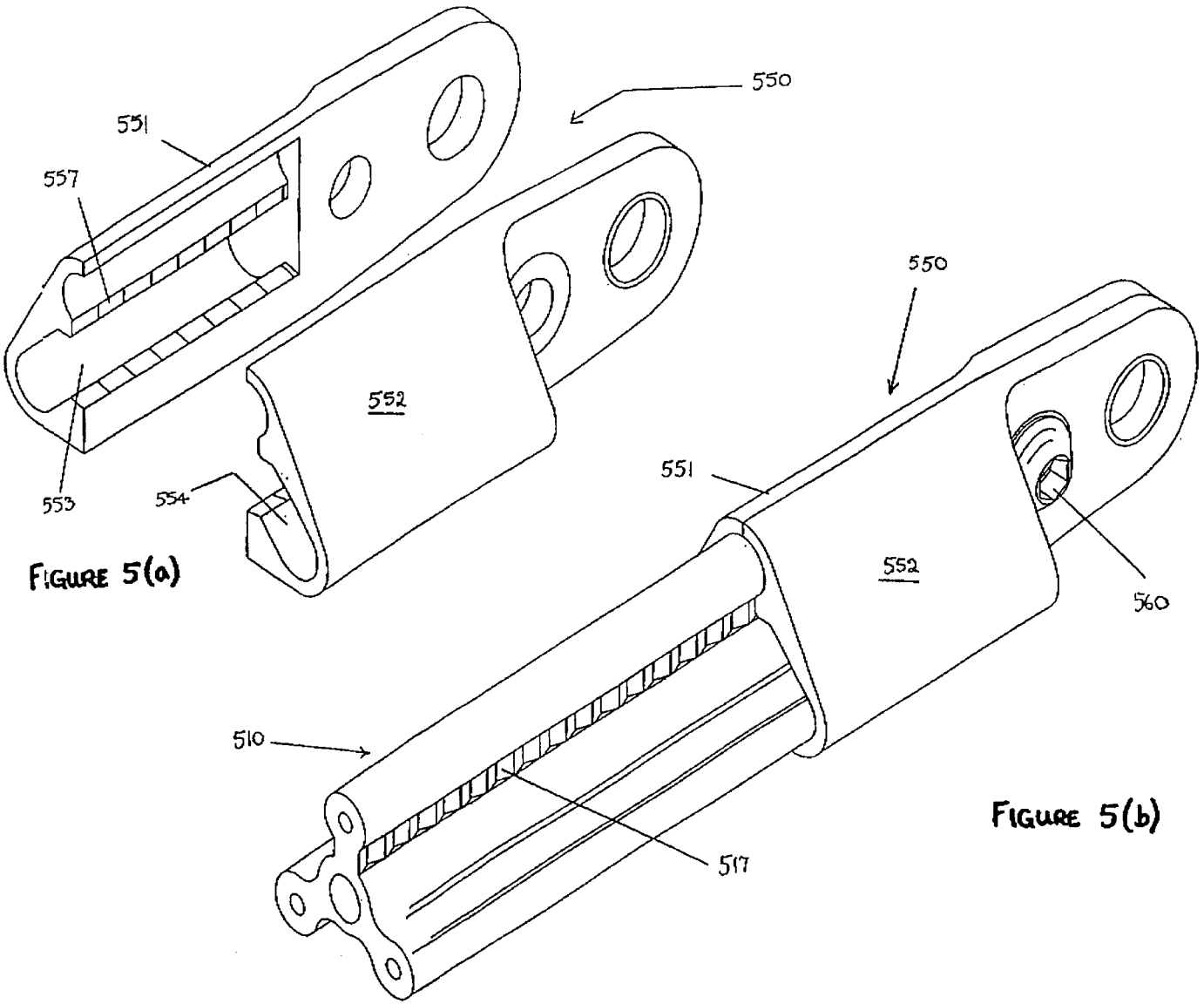
FIGS. 5(*a*) and 5(*b*) show a series of perspective views showing in exploded and assembled form an end anchor for supporting the flexible track of FIGS. 2(*a*), 2(*b*) and 2(*c*) under tension.

FIG. 5(*a*) shows an exploded view of an end anchor 550 for supporting a flexible track 510 (see FIG. 5(*b*) under tension. The anchor 550 is formed in two separable parts 551, 552, each having an hollowed-out track-receiving housing 553, 554 configured to match the profile of the track 510 when the parts 551, 552 are brought together in face-to-face relationship. In particular, it is to be noted that the parts 551, 552 have a series of serrations 557 formed on an internal surface of each of the track-receiving housings 553, 554. These serrations 557 are adapted to engage with serrations 517 formed on the flexible elongate element 510. The track-receiving housings 553, 554, are formed with a bluff end wall which forms part of a respective longitudinal extension 555, 556. Extension elements each have a pair of transverse holes drilled therethrough, said holes being arranged to align with each other when the parts are brought together in face-to-face relationship for anchoring the flexible elongate element 510. One of the pairs of holes is used to bolt the two parts 551, 552 together. The other pair of holes is used to secure the end anchor to a portion of the fixed structure in known fashion.

FIG. 5(*b*) shows the end anchor 550 in its assembled condition with a length of flexible track 510 securely held in place in the respective track-receiving housings 553, 554. FIG. 5(*b*) also shows the head of a bolt 560 used to clamp the two parts 551, 552 together.

Figure 6A:
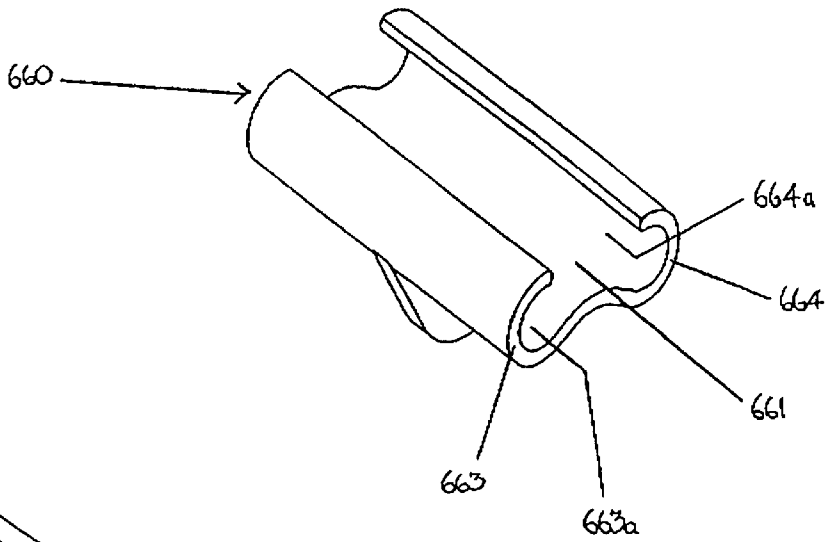
FIGS. 6(*a*) and 6(*b*) show a series of perspective views of an embodiment of shuttle means adapted to conform to the flexible track profile of the embodiment of FIGS. 2(*a*), 2(*b*) and 2(*c*)
Figure 6B:
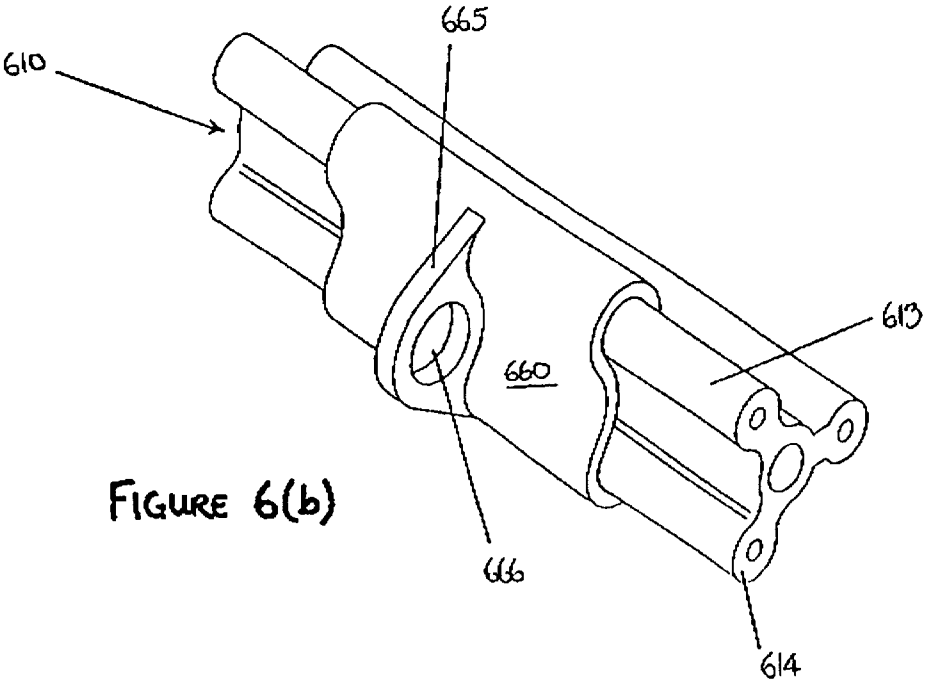

Turning now to FIG. 6(*a*), a perspective view of one embodiment of a simple shuttle 660 is adapted for slidable engagement with a trilobal flexible elongate element (see FIG. 6(*b*)). The shuttle 660 has a length which is approximately twice as great as the width of the flexible elongate element 610 measured across two of its lobes 613, 614. The body portion 661 of shuttle 660 is slightly concave in cross-section, enabling it to conform more closely with the cross-section of the flexible elongate element 610. This matching of cross-sections may be significant in areas of the installation where clearances are tight. The body portion 661 supports a pair of transverse arms 663, 664 that wrap around at their edges remote from the body portion 661 to form respective channels 663*a*, 664awhich partially surround the lobes 613, 614 of the flexible elongate element 610 in use.

As best seen in FIG. 6(*b*), the underside of shuttle 660 is provided with a flange 665 protruding substantially perpendicularly from the midpoint of the body portion 661. Flange 665 has a connecting eye 666 for receipt of a connecting device such as a karabiner from which a load or personnel safety harness may be suspended.

It will be understood by a person skilled in the art that other designs of shuttle are possible. For example, the flange 665 could be oriented to align with the longitudinal axis of the body portion 661, the connecting eye 666 having an orientation which is transverse to said longitudinal axis. The materials of the shuttle 660 and the flexible elongate element 610 are chosen such that at least their co-operating surfaces are capable of low-friction engagement. Alternatively, the shuttle 660 could be modified to include friction-reducing mechanical features, such as wheels, rollers, ball races or similar devices, to assist in its smooth passage along the flexible elongate element 610.

Figure 7:
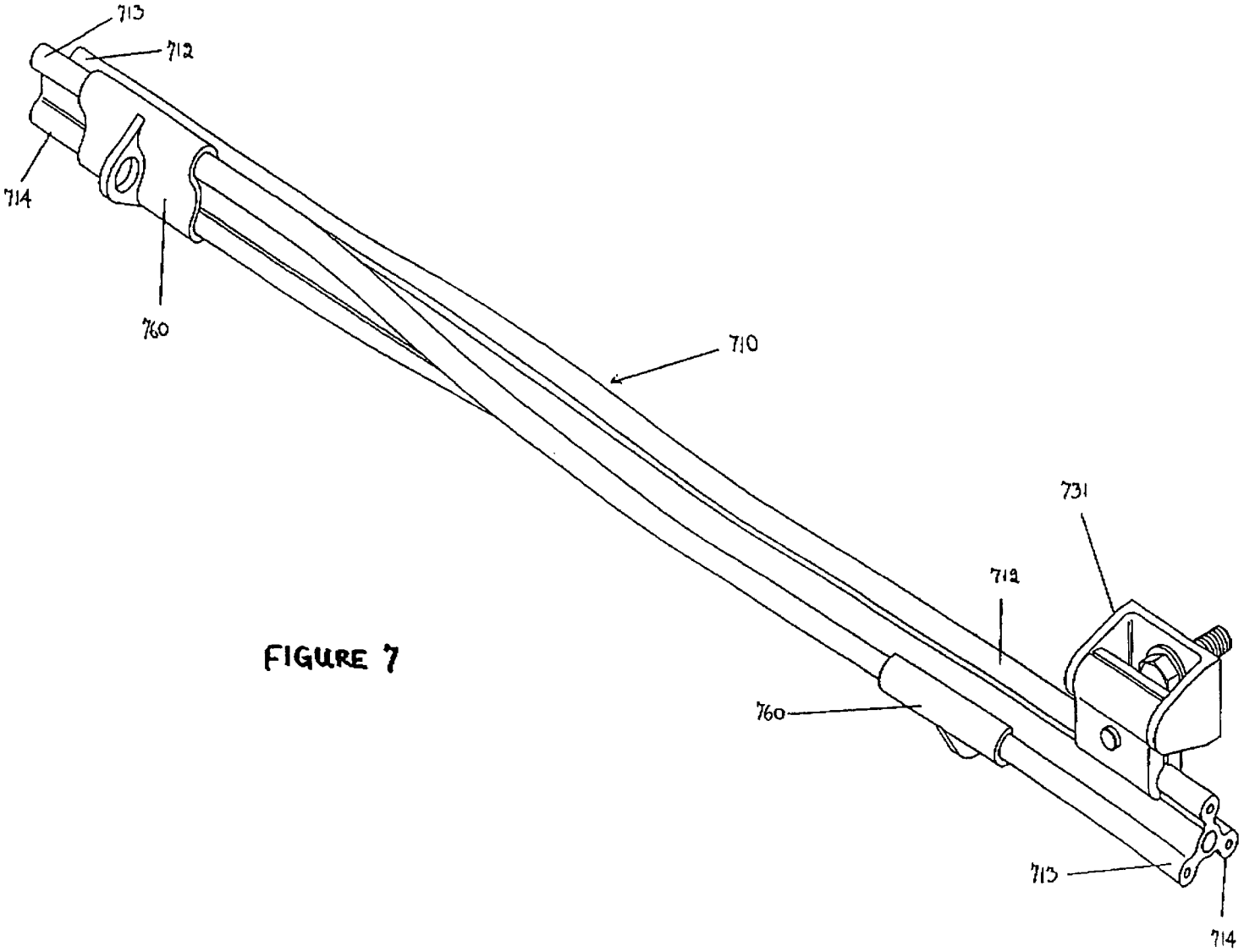
FIG. 7 shows a perspective view of a length of flexible track to which a helical twist has been imparted, showing an intermediate support bracket and the uninterrupted running surface with two shuttle means installed thereon.

Turning now to FIG. 7, a flexible elongate element 710 of trilobal cross-section is shown. Element 710 is suspended by its lobe 712 between the jaws of an intermediate support bracket 731. The flexible elongate element 710 carries a pair of shuttles 760 and is shown in this view with a helical twist of approximately 120° about its longitudinal axis. Provided that the flexible elongate element 710 is consistently supported by brackets that engage its lobe 712, the running surface defined by lobes 713 and 714 remains uninterrupted, regardless of the relative helical orientation of the flexible elongate element 710. The capability to execute helical twists may be useful, for example, in situations where the track installation passes from one side of a narrow walkway to the other side thereof by passing overhead. An uninterrupted running surface can be provided for shuttles 760 by twisting the flexible elongate element 710 about its longitudinal axis as it executes the overhead pass.

Figure 8:
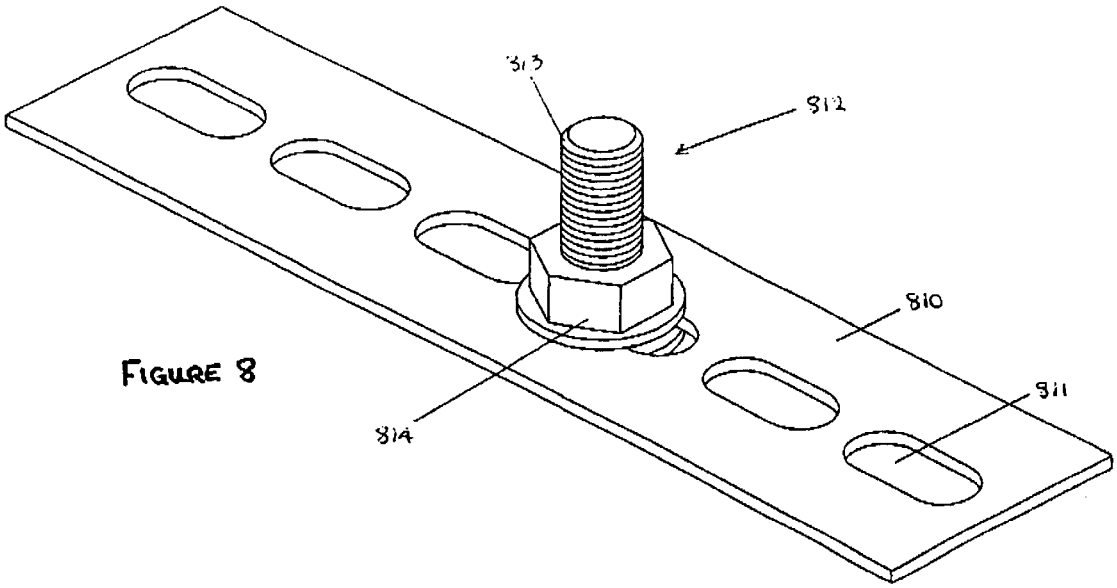
FIG. 8 shows a perspective view of an alternative track form.

FIG. 8 shows another form of track suitable for use with the present invention. The track is a flat strip 810 of flexible elongate material, such as spring steel or the like. The centre portion of the strip 810 is provided with a series of holes 811 adapted to receive suspension bolts 812 at intervals for supporting the track from a fixed structure. The head of the bolt 812 is not visible in this view, but its threaded shank 813 is engaged by a nut 814 having a complementary screw thread. Nut 814 secures the bolt 812 to the strip 810. The protruding portion of the threaded shank 813 may then be used for attachment of the strip/suspension bolt assembly to a fixed structure in a manner that will be understood by persons skilled in the art.

The suspended strip 810 has fixing means only along its centre portion and its edges are clear to maintain an uninterrupted path for suitably adapted shuttle means. Clearly, the shuttle means will need to be designed to pass the heads of suspension bolts 812 without fouling.

Figure 9:
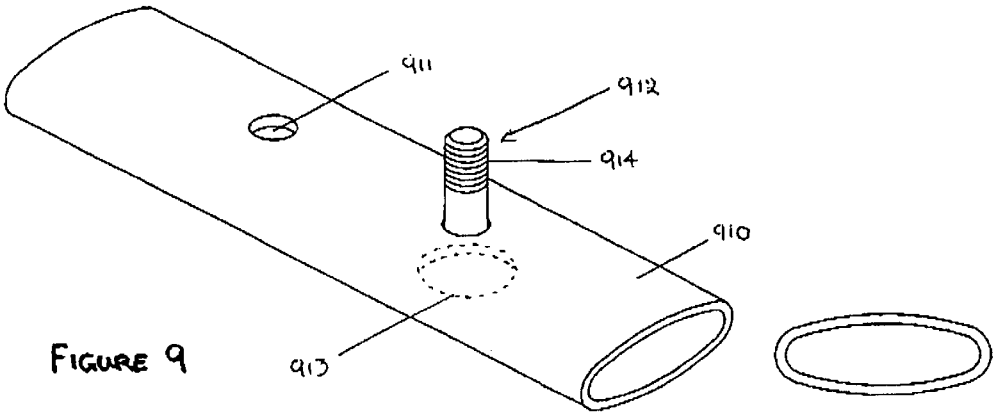
FIG. 9 shows a perspective view of yet another possible track form.

FIG. 9 shows yet another possible track formation suitable for use with the present invention.

In this variant, the elongate element is formed as a hollow profile 910, here shown with an elliptical in the art that other cross-sections are possible. The hollow profile 910 is provided with a series of holes 911 along its upper surface adapted to receive droppers 912 at intervals (only one shown) for supporting the profile from a fixed structure. In practice, the droppers 912 may be in the form of threaded bolts inserted through a larger hole provided on the opposite surface of the profile 910. One such larger hole is shown in ghost outline in the Figure, denoted by the reference number 913. The head of the bolt bears against the interior of the hollow profile 910 and its threaded shank 914 protrudes through the hole 911 for attachment to a fixed structure in a manner that will be understood by persons skilled in the art. The head of the bolt is thus concealed within the hollow profile 910 so that shuttle means suspended from the track and traveling therealong are presented with an unobstructed path. The underside of the track 910 has a series of large holes throughout its length, but these are no impediment to free movement of the shuttle means.

Although the invention has been particularly described with reference to specific embodiments, it will be understood by persons skilled in the art that these are merely illustrative and that variations are possible without departing from the scope of the claims which follow.

In accordance with the present invention, I claim:

1. A height safety system comprising a flexible elongate element, said element being pretensioned between support brackets at intervals to stiffen its linear form, and shuttle means coupled to said elongate element adapted for movement therealong, said shuttle means including attachment means for receiving a suspended load or a personnel safety line;

said elongate element having primary and secondary track formations independent from each other, said primary track formation providing a continuous path along which said shuttle means is able to traverse without interruption, and said secondary track formation providing attachment points for said support brackets at any point along the extent of the element without obstructing said primary track formation.

2. A height safety system as claimed in claim 1 wherein the elongate element is a flat strip.

3. A height safety system as claimed in claim 1 wherein said secondary track formation of said elongate element is provided on a rear surface thereof.

4. A height safety system as claimed in claim 3 wherein said secondary track formation is a continuous lobe.

5. A height safety system as claimed in claim 1 wherein the elongate element has a cross-section with a centre portion and at least two lobes protruding therefrom.

6. A height safety system as claimed in claim 5 wherein at least one of the lobes constitutes said secondary track formation and is arranged to be engageable by intermediate support brackets.

7. A height safety system as claimed in claim 6 wherein said intermediate support brackets grip said secondary track formation with a predetermined clamping force that allows the elongate element to pull through the intermediate support brackets in response to an applied tensile load exceeding the predetermined clamping force, until the tensile load equals the predetermined clamping force, whereby said tensile load is partially transferred to an adjacent span of the elongate element.

8. A height safety system as claimed in claim 5 wherein at least one of the lobes is arranged to provide an uninterupted running surface for said shuttle means.

9. A height safety system as claimed in claim 6 wherein said elongate element is slidable relative to said intermediate support brackets.

10. A height safety system as claimed in claim 1 wherein the elongate element is a hollow profile.

11. A height safety system as claimed in claim 10 wherein intermediate guides are provided in the form of droppers engageable with the interior of the elongate element.

12. A height safety system as claimed in claim 1 wherein the configuration of the shuttle means is such that it partially encircles at least a part of the elongate element.

13. A height safety system as claimed in claim 1 wherein the elongate element is provided with a surface formation for cam locking purposes in a fall-arrest situation.

14. A height safety system as claimed in claim 1 wherein the elongate element is provided with surface formations at its ends to ensure sound gripping by fixed anchors.

15. A height safety system as claimed in claim 14 wherein the fixed anchors are provided with complementary surface formations to promote gripping.

16. A height safety system as claimed in claim 1 wherein said elongate element has a longitudinal axis and a helical twist about said longitudinal axis.

17. A height safety system as claimed in claim 16 wherein the amount of said helical twist is at least 90°.

18. A height safety system as claimed in claim 1 wherein said elongate element has a longitudinal axis and a bend transverse to said longitudinal axis.

19. A height safety system as claimed in claim 18 wherein said bend is at least 90°.

* * * * *